United States Patent [19]

Otani

[11] Patent Number: 4,472,265

[45] Date of Patent: Sep. 18, 1984

[54] DORMANT MESOPHASE PITCH

[75] Inventor: Sugio Otani, Kiryu, Japan

[73] Assignee: Fuji Standard Research Inc., Tokyo, Japan

[21] Appl. No.: 329,432

[22] Filed: Dec. 10, 1981

[30] Foreign Application Priority Data

Dec. 15, 1980 [JP] Japan ..... 55-176813

[51] Int. Cl.[3] ..... C10C 3/00; D01F 9/14

[52] U.S. Cl. ..... 208/22; 208/44; 423/447.4; 423/447.6; 423/447.1

[58] Field of Search ..... 208/22, 44; 423/447.4, 423/447.6

[56] References Cited

U.S. PATENT DOCUMENTS

| | | | |
|---|---|---|---|
| 2,772,219 | 11/1956 | Dunkel et al. | 208/22 |
| 3,723,150 | 3/1973 | Druin et al. | 423/447 |
| 3,745,104 | 7/1973 | How | 423/447.6 |
| 3,754,957 | 8/1973 | Druin et al. | 423/447.6 |
| 3,787,541 | 1/1974 | Grindstaff et al. | 423/448 |
| 3,814,642 | 6/1974 | Araki et al. | 156/60 |
| 3,917,806 | 11/1975 | Amagi et al. | 423/447 |
| 3,928,170 | 12/1975 | Takahashi et al. | 208/40 |
| 3,974,264 | 8/1976 | McHenry | 264/29.2 |
| 3,991,170 | 11/1976 | Singer | 208/22 |
| 4,115,527 | 9/1978 | Otani et al. | 423/447.4 |
| 4,138,525 | 2/1979 | Schulz | 264/292 |
| 4,146,576 | 3/1979 | Wyss | 423/447.4 |
| 4,184,942 | 1/1980 | Angier et al. | 208/44 |
| 4,209,500 | 6/1980 | Chwastiak | 264/29.2 |
| 4,213,956 | 7/1980 | Ubbelohde | 264/29.1 |
| 4,272,501 | 6/1981 | Cereskoviek et al. | 264/29.2 |
| 4,303,631 | 12/1981 | Lewis et al. | 423/447.1 |
| 4,331,620 | 5/1982 | Diefendorf et al. | 264/29.2 |

FOREIGN PATENT DOCUMENTS

| | | | |
|---|---|---|---|
| 0044714 | 1/1982 | European Pat. Off. | 208/44 |

*Primary Examiner*—Delbert E. Gantz
*Assistant Examiner*—Helane E. Maull
*Attorney, Agent, or Firm*—Stephen F. K. Yee

[57] ABSTRACT

A novel carbonaceous pitch which is optically isotropic in nature and which turns into optically anisotropic when shear forces are applied thereto. The carbonaceous pitch may be obtained by hydrogenating the mesophase of a mesophase pitch to the extent that the mesophase is rendered soluble in quinoline. The carbonaceous pitch is useful as a binder and an impregnator and as a precursor material for a highly oriented, high-strength and high-modulus carbon fiber, needle coke or the like carbonaceous materials.

18 Claims, 8 Drawing Figures

DORMANT MESOPHASE PITCH

BACKGROUND OF THE INVENTION

This invention relates generally to a carbonaceous pitch and, more specifically, to a novel, dormant mesophase pitch which is optically isotropic in nature but turns into an optically anisotropic material when subjected to shear forces. This invention is also directed to a process for the preparation of such a dormant mesophase pitch and a method of producing a carbon fiber from such a dormant mesophase pitch.

Pitches have been hitherto utilized as binders, impregnators and raw materials for graphite and the like carbonaceous materials. In addition, because of their high carbon content, pitches have become very important precursor materials for carbon fibers.

As precursor materials for carbon fibers, both optically isotropic and anisotropic pitches have been employed. Natural and synthetic pitches are generally isotropic in nature and afford isotropic carbon fibers with low-strength and low-modulus. On the other hand, anisotropic pitches can form carbon fibers having a strength and a modulus as high as those obtained from rayon or acrylic fibers. Therefore, the recent trend in the production of carbon fibers is towards the use of anisotropic pitches as starting materials.

Anisotropic pitches may be produced by thermal treatment of natural or synthetic pitches which are generally composed of condensed ring aromatics or average molecular weight of a few hundred or less and which are isotropic in nature. That is, when such isotropic pitches are heated to a temperature of about 350°-450° C., anisotropic, small spheres begin to appear in the matrix of isotropic pitch through cyclization, aromatization, polycondensation and the like reactions of the aromatics. These small spheres, which are considered to be liquid crystals of a nematic structure, are composed of relatively high molecular weight hydrocarbons having a polycyclic, condensed ring structure and a high aromaticity and are insoluble in quinoline. With the increase in heat treatment time or temperature, these small spheres gradually grow in size and coalesce with each other. As coalescence continues, the pitches turn into an anisotropic state as a whole, with the simultaneous increase in viscosity, and are finally converted into coke. The optically anisotropic, small spheres or their coalesced domains are called "mesophase" and pitches containing such material are termed as "mesophase piches". Conventional carbon fibers or anisotropic structures are produced by spinning a mesophase pitch, rendering the spun fibers infusible and carbonizing the infusible fibers, as disclosed in Japanese Examined Patent Publication No. 49-8634 and Japanese Published Unexamined Patent Applications Nos. 49-19127, 53-65425, 53-119326 and 54-160427.

The production of carbon fibers from mesophase pitches, however, has been found to involve certain difficulties in a mesophase pitch-forming step and in a spinning step. The fundamental problem is involved in the spinning step and is mainly ascribed to the fact that the mesophase components of the pitch have higher melting points and, in the molten state, higher viscosity than the components forming the isotropic matrix of the pitch. Namely, the mesophase pitch, when heated for spinning to a temperature so as to melt the isotropic matrix but not to melt the mesophase components, is thixotropic because of the presence of the solid-like phase mesophase components and, therefore, smooth spinning operation is seriously inhibited. If, on the other hand, the spinning temperature is raised to a temperature permitting the melting of the mesophase components, then the mesophase components, which are thermally unstable, gradually increase in their viscosity by polymerization and tend to form coke. Especially, in the case of the mesophase pitch having a high mesophase content, such coking proceeds very fast to the extent that the continuous spinning operation is considerably inhibited. Thus, although anisotropic carbon fibers derived from mesophase pitches have superior mechanical properties in comparison with isotropic carbon fibers obtained from isotropic pitches, the production of the anisotropic fibers inherently encounters with a problem in spinning step. In the conventional process for the production of anisotropic carbon fibers, therefore, it is essential to prepare mesophase pitches of a specific type having high spinnability.

As starting materials for other carbonaceous materials than carbon fibers, the known mesophase pitches are not satisfactory because they are not thermally stable and are viscous in the molten state. The known isotropic pitches are also not suitable enough as binders or impregnators since they fail to provide a high carbon yield.

SUMMARY OF THE INVENTION

It is, therefore, an object of the present invention to provide a dormant mesophase pitch which is optically isotropic in nature but turns into anisotropic when subjected to shear forces in one direction.

Another object of the present invention is to provide a pitch of the above-mentioned type which has a low melting point, which is low in viscosity in the molten state and which has an excellent thermal stability.

It is a further object of the present invention to provide a pitch of the above-mentioned type which is useful as binders, impregnators and starting materials for various carbonaceous materials such as needle coke, graphite and the like.

It is a special object of the present invention to provide a pitch of the above-mentioned type which has an improved spinnability and which is useful as a precursor material for high-strength, high-modulus carbon fibers.

It is yet a further object of the present invention to provide a process for the preparation of a carbonaceous pitch of the above-mentioned type.

In accomplishing the foregoing objects, there is provided in accordance with the present invention a carbonaceous pitch comprising dormant anisotropic hydrocarbon components which are substantially soluble in quinoline and which are partially hydrogenated materials of the mesophase of a mesophase pitch, said carbonaceous pitch being optically isotropic in nature but, upon being subjected to shear forces in one direction, capable of being oriented in said direction.

In another aspect of the present invention, there is provided a process for preparing a carbonanceous pitch, comprising providing a mesophase pitch, and hydrogenating the mesophase of said mesophase pitch so that the mesophase may become substantially soluble in quinoline. In a further aspect, the present invention provides a process for the production of a carbon fiber using the above carbonaceous pitch.

BRIEF DESCRIPTION OF THE DRAWINGS

Other objects, features and advantages of the present invention will become apparent from the detailed description of the invention which follows, when considered in light of the accompanying drawings, in which:

FIG. 3(*b*) is a polarized light photomicrograph similar to FIG. 3(*a*) but in the state wherein the stage of the microscope is turned right by an angle of 45°;

FIG. 3(*c*) is a polarized light photomicrograph similar to FIG. 3(*b*) but in the state wherein the stage of the microscope is turned right by another 45°;

DETAILED DESCRIPTION OF THE INVENTION

Figure 1:
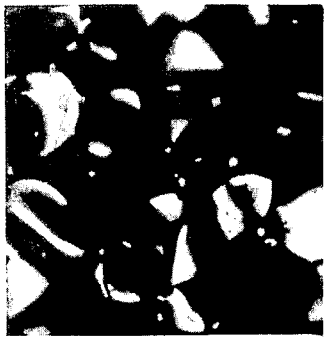
FIG. 1 is a polarized light photomicrograph (a magnification of 400×) of the surface of a mesophase pitch used in the Example.

The carbonaceous pitch of this invention is termed "dormant mesophase pitch" and is comprised of latently optically anisotropic hydrocarbon components (hereinafter referred to simply as dormant anisotropic components) which are partially hydrogenated, polycyclic, polycondensed ring aromatic hydrocarbons obtained by hydrogenation of the mesophase of a mesophase pitch and which are substantially soluble in quinoline.

The dormant mesophase pitch, in contrast with the conventional mesophase pitch, is optically isotropic in nature and is a homogeneous liquid in a single phase when heated above its melting point. When subjected to shear forces in one direction, however, the dormant mesophase pitch, unlike the usual isotropic pitch, turns into optically anisotropic due to the presence of the dormant anisotropic components capable of being oriented in the direction parallel to the direction of the forces.

The dormant mesophase pitch generally has a melting point in the range of about 150°–300° C. When heated above the melting point, it is non-thixotropic and exhibits Newtonian flow behavior. More specifically, it exhibits a viscosity of below about 100 poises at a temperature of about 200°–300° C. Moreover, the dormant mesophase pitch, which is free of mesophase, is stable and, in practice, does not undergo coking even if it is kept at a temperature of about 350° C.

All the above characteristics of the dormant mesophase pitch of this invention permit the use thereof as, for example, a precursor material for highly oriented carbon fibers. Especially, the properties of the dormant mesophase pitch are very advantageous in spinning the pitch into uniform fibers.

The dormant mesophase pitch of this invention has a H/C atomic ratio of 0.55–1.2. Similar to isotropic pitches, the dormant mesophase pitch may form mesophase when heated under quiescent conditions at a temperature of 350° C. or more, though the temperature varies according to the kind of the dormant mesophase pitch, heating time and other heating conditions.

The typical properties of the dormant mesophase pitch are summarized in Table below, together with those of the conventional mesophase pitch and isotropic pitch.

TABLE

| | Mesophase pitch | Dormant mesophase pitch | Isotropic pitch |
|---|---|---|---|
| Quinoline insoluble content (wt %) | 5–100 | 0 | 0 |
| H/C atomic ratio | 0.43–0.75 | 0.55–1.2 | 0.6–1.8 |
| Number of phase in molten state | 2 | 1 | 1 |
| Optical properties | anisotropic | latently anisotropic | isotropic |
| Melting point (°C.) | 300–450 | 150–300 | 300 or less |
| Fluidity (°C.)* | 300–450 | 200–300 | 80–280 |
| Thermal stability** | unstable | stable | stable |

*Temperature at which the pitch can exhibit a viscosity of 100 poises
**Thermal stability at spinning temperature The dormat mesophase pitch may be prepared by hydrogenating the mesophase of a mesophase pitch to such an extent that substantially all the mesophase may be converted into substances soluble in quinoline. Any mesophase pitches can be used for the preparation of the dormant mesophase pitch. Mesophase pitches obtained from synthetic or natural pitches such as petroleum and coal tar pitches are suitably employed. It is preferable to use mesophase pitches having a mesophase content of 1–90 wt %, especially 5–70 wt %. The mesophase pitch suitably employed for the production of the dormant mesophase pitches generally has a H/C atomic ratio of 0.43–0.75, preferably 0.45–0.65.

The hydrogenation is done for the purpose of partially hydrogenating polycyclic, polycondensed ring aromatic hydrocarbons constituting the mesophase. Any known hydrogenation techniques customarily employed for hydrogenation of aromatic nuclei be adopted. Illustrative of such hydrogenation techniques are reduction using an alkali metal, an alkaline earth metal or a compound thereof; electrolytic reduction; homogeneous catalytic hydrogenation using a complex catalyst; and hetrogeneous catalytic hydrogenation using a solid catalyst containing one or more metals, for example, metals belonging to Group VIII of the Periodic Table. Other methods such as hydrogenation under pressure of hydrogen without using catalyst and hydrogenation using hydrogen donor such as tetralin may also be used. It is preferred that the hydrogenation be effected while preventing hydrocracking as much as possible.

Reaction conditions under which the hydrogenation of the mesophase pitch is performed vary according to the hydrogenation method employed. Generally, the hydrogenation is conducted at a temperature not higher than about 400° C. and a pressure of 1–200 atm. and, if necessary, using a suitable solvent or dispersing medium. In some cases, mesophase pitches may be subjected to hydrogenation conditions in the powdery or molten state.

The hydrogenation of mesophase pitches should be continued until substantially all the mesophase contained therein may disappear and may be converted into quinoline soluble, dormant anisotropic components having a structure containing three or more condensed, partially hydrogenated benzene nuclei.

In order to improve the properties of the thus obtained hydrogenated pitch, especially its thermal stability, it is preferred that the pitch be maintained in the softened or molten state for a period of time so that low melting-boiling point components contained therein may be vaporized or unstable materials contained therein may be converted, through hydrogenation or the like, into stable components. Such heat treatment is performed generally at a temperature of not higher than 450° C., preferably about 280°–430° C., and under a pressurized or normal or reduced pressure condition. If desired, the heat treatment is carried out in an inert atmosphere, for example, by bubbling an inert gas through the hydrogenated pitch. It is important that the heat treatment should be carried out under controlled conditions so as to substantially prevent mesophase from forming again.

In an alternative, the dormant mesophase pitch can be prepared by a method including subjecting a mesophase pitch to solvent extraction for separating it into quinoline insolubles (mesophase) and quinoline solubles and hydrotreating the separated mesophase in the manner as described above. The hydrotreatment product consisting mainly of dormant anisotropic components is then mixed with an isotropic pitch or the quinoline solubles obtained in the above extraction step. The quinoline solubles may be used either as such or after being hydrotreated.

The dormant mesophase pitch produced in the manner described above has a H/C ratio of 0.55–1.2. Whether or not the product thus produced be latently anisotropic can be determined by polarized light microscope techniques. For this purpose, the pitch is embedded in a resinous body and the surface of the embedded pitch is polished, in the conventional manner, to provide a pitch sample for polarized light microscope examination. If the sample is anisotropic pitch rather than dormant mesophase pitch, the polarized light microscope examination will reveal anisotropic domains caused by the presence of the mesophase. The sample, if negative in polarized light microscope examination, is then rubbed by a brush, paper or any other materials in one direction. If the rubbed surface shows orientation in the rub direction upon examination by polarized light microscopy, the sample may be regarded as being a dormant mesophase pitch. Since the orientation developed by exerting such a shear force on the sample is not high enough to be clearly detectable, it is advisable to divide the surface of the sample into two regions with their rub directions being perpendicular with each other. By comparingly examining the two regions simultaneously by the polarized light microscope, the orientation can be seen clearly.

As described previously, the dormant mesophase pitch is advantageously used as a precursor material for carbon fibers. The transformation of the dormant mesophase pitch into carbon fibers may be effected by a method including the steps of: heating the dormant mesophase pitch above its melting point, generally to a temperature of 200°–300° C.; spinning a carbonaceous fiber from the molten pitch; exposing the spun fiber to an oxygen-containing atmosphere so that the spun fiber is rendered infusible; heat-treating the infusible fiber over about 800° C. in an inert atmosphere. The heat treatment includes heating the infusible fiber at a temperature of 800°–1500° C., preferably gradually increasing the temperature at a rate of 2°–50° C./min, more preferably 5°–20° C./min, in an inert atmosphere, thereby carbonizing the fiber. The carbonized fiber is, if desired, further heated to a temperature of 2000°–2500° C. in an inert atmosphere for graphatization. Through such a heat treatment, molecular orientation in the direction parallel to the fiber axis is developed.

The spun fiber prior to carbonization frequently fails to exhibit orientation parallel to the fiber axis when examined by polarized light microscope. This is probably because the orientation developed at the surface of the fiber sample during spinning operation is degraded during the polishing step in the preparation of the sample. However, in view of the fact that a high degree of orientation is seen in the carbonized product through X-ray diffraction and polarized light microscopy examination, it is apparent that the spun fiber has been oriented by the shear forces exerted on the dormant mesophase pitch during spinning of the fiber.

In addition to carbon fibers, the dormant mesophase pitches according to the present invention may be advantageously used as binders, impregnators, etc. because of their high content of components soluble in quinoline but insoluble in benzene and their low viscosity in the molten state. Also, the dormant mesophase pitches of this invention are very useful as starting materials for needle coke, easily graphatizable carbonaceous materials and the like because of their good processability, i.e. they are stable in the molten state and exhibit suitable flow behavior in a wide temperature range.

The following example will further illustrate the present invention. In the present specification, the letters "QI", "QS", "BI" and "BS" mean "quinoline insolubles", "quinoline solubles", "benzene insolubles" and "benzene solubles", respectively. The percentages of QI and QS are determined by quinoline extraction at 70° C., while those of BI and BS are by benzene extraction at 80° C. in accordance with Japanese Industrial Standard K 2425.

EXAMPLE

An isotropic pitch obtained from a product oil produced in a fluidized bed catalytic cracking is heated under quiescent conditions at a temperature of 420° C. to obtain a mesophase pitch having a H/C ratio of 0.57. Solubility examination revealed that the mesophase pitch had QI, QS-BI and BS contents of 32.8 wt %, 48.3 wt % and 18.9 wt %, respectively. A polarized light photomicrograph of the mesophase pitch (a magnification of 400×) is shown in FIG. 1, in which a number of optically anisotropic small spheres, i.e. mesophase, are observed. It was difficult to effect melt-spinning of the mesophase pitch into fibers at a temperature of 340° C. and a spinning rate of 100 m/min.

The mesophase pitch was ground into powder and 30 g of the powdery pitch were subjected to Birch's reduction using 30 g of lithium metal in 2 liters of ethylene diamine at a temperature of 95° C. for 2 hours to obtain a partially hydrogenated product having a H/C ratio of 1.01 and QI, QS-BI and BS contents of below 0.4 wt %, 36.5 wt % and 63 wt %, respectively. This pitch product, in the molten state, was substantially homogeneous liquid.

Figure 2:
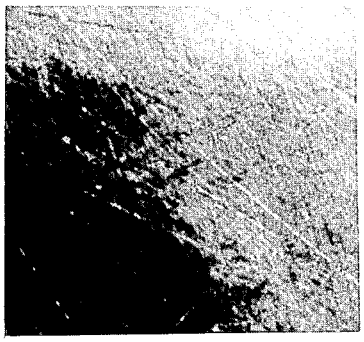
FIG. 2 is a polarized light photomicrograph of a dormant mesophase pitch obtained in the Example.
Figure 3A:
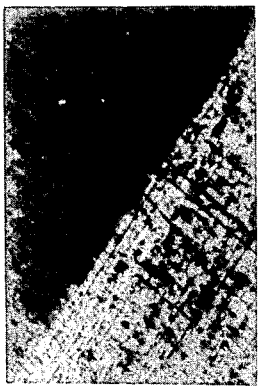
FIG. 3(*a*) is a polarized light photomicrograph of two rubbed surface portions of the dormant mesophase pitch of the Example, and directions of the rub being perpendicular with each other as indicated by the arrows.
Figure 3B:
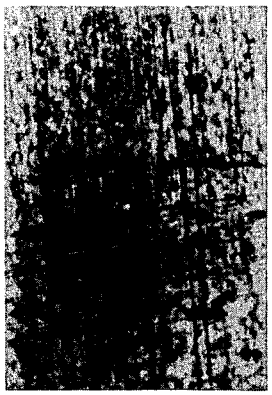
Figure 3C:
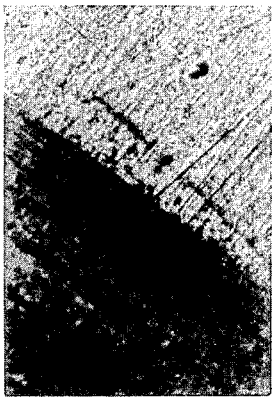

The pitch product was then heated to 400° C. in the atmosphere of nitrogen and then subjected to slightly reduced pressure conditions to remove low molecular weight substances. The heat-treated pitch thus obtained had a QI of below 0.3 wt % and a H/C ratio of 0.98. As will be appreciated from the polarized light photomicrograh shown in FIG. 2, the pitch contained no mesophase. As shown in FIGS. 3(*a*), 3(*b*) and 3(*c*), however, slight orientation was developed upon rubbing the surface of the pitch by a filter paper. In FIGS. 3(*a*)–3(*c*), the arrows show the direction of rubbing. This pitch is thus regarded as being a dormant mesophase pitch. The pitch had a softening point of about 240° C. and, when allowed to stand at 350° C. for 3 hours in the atmosphere of nitrogen, was still optically isotropic in nature.

The dormant mesophase pitch was then spun into fibers by means of an extruder. The spinning operation was conducted at a temperature of 270°–280° C., a spinning rate of 350 m/min and a spinning pressure of higher by 35 cm Aq. than atmospheric pressure with use of an orifice having 0.6 mm diameter.

Figure 4:
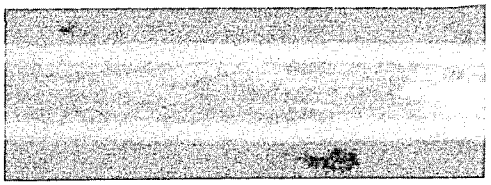
FIG. 4 is a polarized light photomicrograph (a magnification of 800×) of a longitudinal section of the carbon fiber obtained in the Example.
Figure 5:
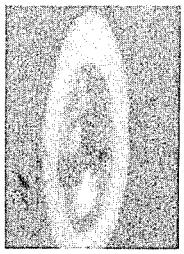
FIG. 5 is a polarized light photomicrograph similar to FIG. 4 but showing the cross section.

The spun fibers were then gradually heated in the air up to a temperature of 280° C. so that the fibers were rendered infusible. The infusible fibers were subsequently heated up to 1000° C. in the atmosphere of argon at a heat-up rate of 5° C./min to obtain carbonized fibers. Photomicrographs under polarized light of longitudinal section and cross section of the carbonized fibers are shown in FIGS. 4 and 5, respectively. A high degree of orientation parallel to the fiber axis is observed in FIG. 4. The carbonized fibers were found to exhibit a tensile strength of 250 $Kg/mm^2$ and a Young's modulus of 20,000 $Kg/mm^2$.

Figure 6:
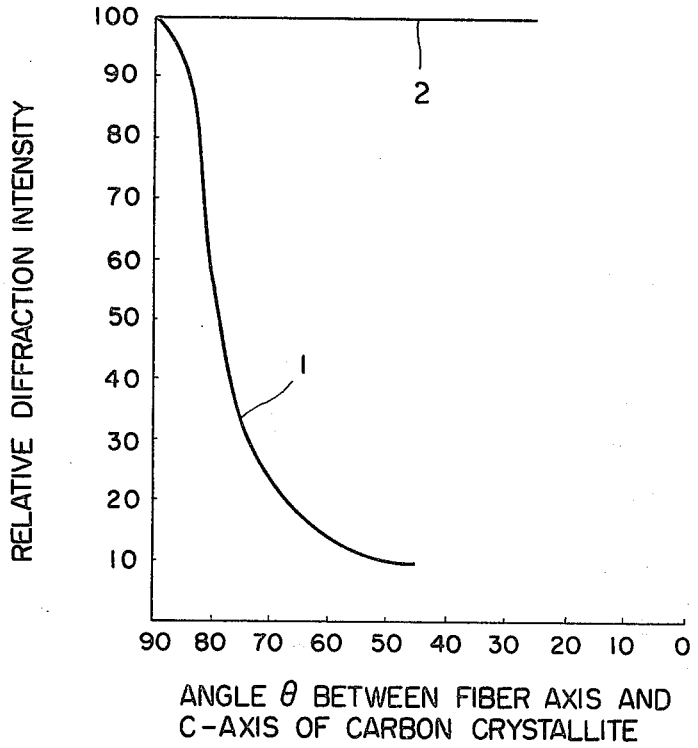
FIG. 6 is a graph showing the change in relative diffraction intensity (DI) of X-ray diffraction on (002) line in relation to the change in angle $\theta$ between the fiber axis and the C-axis of the carbon crystallite.

A further heat treatment of the thus obtained carbonized fibers up to 2500° C. gave graphatized fibers having a tensile strength of 200 $Kg/mm^2$ and a Young's modulus of 40,000 $Kg/mm^2$. The degree of orientation of the graphatized fibers was examined by X-ray diffraction techniques, the results of which are shown by way of a graph in FIG. 6. In FIG. 6, the abscissa stands for the angle $\theta$ between the fiber axis and the C-axis of the carbon crystallite, while the ordinate stands for the relative diffraction intensity (DI). In the case of an isotropic carbonaceous material or isotropic graphite fiber, the relative diffraction intensity DI is constant irrespective of the change in angle $\theta$, as shown by the line 2. The relative diffraction intensity, as shown by the line 1, changes with the change in angle $\theta$ in the case of the graphite fiber produced from the dormant mesophase pitch, indicating the establishment of a high degree of orientation in the fibers.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

I claim:

1. A carbonaceous pitch comprising dormant anisotropic components which are partially hydrogenated, polycyclic polycondensed ring aromatic hydrocarbons derived from the mesophase of a mesophase pitch by hydrogenation of said mesophase and which are soluble in quinoline, said carbonaceous pitch being optically isotropic in nature but, upon being subjected to shear forces in one direction, capable of being oriented in said direction.

2. A carbonaceous pitch as claimed in claim 1, and having a H/C atomic ratio of 0.55 to 1.2.

3. A carbonaceous pitch as claimed in claim 1, wherein said mesophase pitch has a mesophase content of 1 to 90 wt %.

4. A carbonaceous pitch as claimed in claim 1, wherein said mesophase pitch has a mesophase content of 5 to 70 wt %.

5. A carbonaceous pitch as claimed in claim 1, and being a homogeneous liquid when heated above its melting point.

6. A carbonaceous pitch as claimed in claim 1, and having a melting point of about 150° to 300° C.

7. A carbonaceous pitch as claimed in claim 1, and exhibiting a viscosity of about 100 poises when heated to 200° to 300° C.

8. A process for the preparation of a carbonaceous pitch which is optically isotropic in nature but is capable of being oriented in one direction when subjected to shear forces in said direction, comprising providing a mesophase pitch, and hydrogenating the mesophase of said mesophase pitch so that the mesophase is rendered soluble in quinoline.

9. A process as claimed in claim 8, wherein said hydrogenation comprises subjecting said mesophase pitch to hydrogenating conditions, so that substantially all the mesophase contained therein is rendered soluble in quinoline.

10. A process as claimed in claim 8, wherein said mesophase pitch has a H/C atomic ratio of 0.43 to 0.75.

11. A process as claimed in claim 10, wherein said mesophase pitch has a H/C atomic ratio of 0.45 to 0.65.

12. A process as claimed in claim 8, wherein the product of said hydrogenation is heated above its melting point for a period of time sufficient to remove low boiling point components therefrom.

13. A process as claimed in claim 12, wherein the product of said hydrogenation is heated to a temperature of about 450° C. or less.

14. A process as claimed in claim 13, wherein the product of said hydrogenation is heated to a temperature of about 280° to 430° C.

15. A process as claimed in claim 8, wherein said mesophase pitch has a mesophase component of 1 to 90 wt %.

16. A process as claimed in claim 8, wherein said mesophase pitch has a mesophase component of 5 to 70 wt %.

17. A process for the production of a carbon fiber comprising the steps of:

providing a carbonaceous pitch comprising dormant anisotropic components which are partially hydrogenated, polycyclic polycondensed ring aromatic hydrocarbons derived from the mesophase of a mesophase pitch by hydrogenation of said mesophase and which are soluble in quinoline, said carbonaceous pitch being optically isotropic in nature but, upon being subjected to shear forces in one direction, capable of being oriented in said direction;

heating said carbonaceous pitch above its melting point;

spinning a carbonaceous fiber from said molten pitch;

exposing said spun fiber to an oxygen-containing atmosphere so that said spun fiber is rendered infusible; and heat-treating said infusible fiber at temperatures above 800° C.

18. A carbonaceous pitch obtained by hydrogenating the mesophase of a mesophase pitch to render said mesophase soluble in quinoline, said carbonaceous pitch being optically isotropic in nature but being capable of being oriented in one direction when subjected to shear forces in said direction.

* * * * *